US007604313B2

(12) United States Patent
Sekiguchi et al.

(10) Patent No.: US 7,604,313 B2
(45) Date of Patent: Oct. 20, 2009

(54) INK-DROPLET EJECTING APPARATUS

(75) Inventors: Yasuhiro Sekiguchi, Nagoya (JP); Akira Iriguchi, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 591 days.

(21) Appl. No.: 11/380,345

(22) Filed: Apr. 26, 2006

(65) Prior Publication Data

US 2006/0244772 A1 Nov. 2, 2006

(30) Foreign Application Priority Data

Apr. 26, 2005 (JP) ..... 2005-128107
Dec. 20, 2005 (JP) ..... 2005-365874

(51) Int. Cl.
*B41J 29/38* (2006.01)

(52) U.S. Cl. ..... 347/11; 347/10

(58) Field of Classification Search ..... 347/5, 347/9, 14, 15, 57, 68, 74, 10, 11
See application file for complete search history.

(56) References Cited

U.S. PATENT DOCUMENTS 5,402,159 A 3/1995 Takahashi et al.
5,880,750 A * 3/1999 Takahashi ..... 347/10
6,099,103 A 8/2000 Takahashi
6,350,003 B1 2/2002 Ishikawa
6,386,665 B2 5/2002 Takahashi et al.
6,412,896 B2 * 7/2002 Takahashi et al. ..... 347/11
6,416,149 B2 * 7/2002 Takahashi ..... 347/10
6,419,336 B1 * 7/2002 Takahashi ..... 347/10
6,428,136 B2 * 8/2002 Takahashi ..... 347/14
6,595,628 B2 7/2003 Takagi et al.
6,685,293 B2 * 2/2004 Junhua ..... 347/14
6,824,238 B2 * 11/2004 Chang ..... 347/10
6,899,409 B2 * 5/2005 Kusunoki ..... 347/11
7,234,789 B2 * 6/2007 Sekiguchi ..... 347/11

(Continued)

FOREIGN PATENT DOCUMENTS

JP H4 341853 11/1992

(Continued)

*Primary Examiner*—Stephen D Meier
*Assistant Examiner*—Rene Garcia, Jr.
(74) *Attorney, Agent, or Firm*—Baker Botts L.L.P.

(57) ABSTRACT

There is disclosed an ink-droplet ejecting apparatus including: ink passages each including a pressure chamber filled with ink; actuators each operated to change, upon receiving a drive signal, an inner volume of one of the chambers to generate a pressure wave in the ink in the chamber which propagates along the passage to eject a droplet of the ink onto a recording medium; and a control unit connected to the actuators and supplying the signal to the actuators such that the signal is in one of at least one waveform including a waveform which is for forming a single dot on the medium and includes a main pulse for ejecting the droplet, a preceding pulse outputted before the main pulse, and a stabilizing pulse outputted after the main pulse. A pulse width of the main pulse is not coincident with a one-way propagation time AL which is a time taken by the pressure wave to propagate one way along the passage. The preceding pulse is outputted in a manner not to eject the droplet. The stabilizing pulse is outputted in a manner to pull back a part of the droplet as beginning to be ejected by the main pulse.

21 Claims, 10 Drawing Sheets

U.S. PATENT DOCUMENTS

| | | | | |
|---|---|---|---|---|
| 7,258,408 | B2 * | 8/2007 | Usuda | 347/11 |
| 7,410,233 | B2 * | 8/2008 | Kitami et al. | 347/11 |

FOREIGN PATENT DOCUMENTS

| | | |
|---|---|---|
| JP | H11 170515 | 6/1999 |
| JP | H11 227203 | 8/1999 |
| JP | 2001 301161 | 10/2001 |
| JP | 2002 254634 | 9/2002 |
| JP | 3551822 | 5/2004 |

* cited by examiner

FIG.9

| | PULSE WIDTHS AND INTERVALS (×AL) | | | | | EVALUATED PROPERTIES | | |
|---|---|---|---|---|---|---|---|---|
| No. | Tp | Wp | Tm | Wm | Ts | STABILITY | SPEED | VOLUME |
| 1 | 0.33 | 0.11 | 0.56 | 0.56 | 0.33 | G | G | G |
| 2 | 0.22 | 0.11 | 0.56 | 0.67 | 0.44 | G | G | G |
| 3 | 0.22 | 0.11 | 0.56 | 0.78 | 0.33 | G | G | G |
| 4 | 0.20 | 0.30 | 0.60 | 0.60 | 0.20 | G | G | G |
| 5 | 0.22 | 0.44 | 0.78 | 0.67 | 0.11 | G | G | G |
| 6 | 0.11 | 0.22 | 0.89 | 0.67 | 0.33 | G | G | NG |
| 7 | 1.11 | 0.56 | 0.56 | 1.00 | 0.33 | G | G | NG |
| 8 | 0.11 | 1.00 | 1.22 | 0.78 | 0.33 | G | G | NG |
| 9 | 0.22 | 0.33 | 0.89 | 0.78 | 0.44 | G | G | NG |
| 10 | 0.22 | 0.44 | 1.00 | 0.78 | 0.11 | G | NG | NG |
| 11 | 0.11 | 0.11 | 0.67 | 0.22 | 0.11 | G | NG | NG |
| 12 | 0.67 | 1.11 | 0.56 | 0.33 | 0.78 | NG | NG | NG |
| 13 | 0.11 | 1.22 | 0.78 | 0.56 | 0.67 | NG | NG | NG |
| 14 | 0.22 | 0.33 | 1.22 | 0.33 | 0.56 | NG | NG | NG |
| 15 | 0.33 | 1.00 | 0.56 | 1.11 | 0.33 | NG | NG | NG |
| 16 | 0.44 | 0.33 | 0.56 | 0.56 | 0.33 | NG | NG | NG |

FIG.10

| | PULSE WIDTHS AND INTERVALS (μ sec) | | | | | EVALUATED PROPERTIES | | |
|---|---|---|---|---|---|---|---|---|
| | Tp | Wp | Tm | Wm | Ts | STABILITY | DENSITY | |
| 1 | 0.7 | 0.5 | 2.5 | 2.5 | 1.5 | NG | NG | |
| 2 | 0.9 | 0.5 | 2.5 | 2.5 | 1.5 | NG | G | |
| 3 | 1.1 | 0.5 | 2.5 | 2.5 | 1.5 | E | E | |
| 4 | 1.3 | 0.5 | 2.5 | 2.5 | 1.5 | E | E | |
| 5 | 1.5 | 0.5 | 2.5 | 2.5 | 1.5 | E | E | (1) |
| 6 | 1.7 | 0.5 | 2.5 | 2.5 | 1.5 | E | E | (6) |
| 7 | 1.9 | 0.5 | 2.5 | 2.5 | 1.5 | E | E | |
| 8 | 2.1 | 0.5 | 2.5 | 2.5 | 1.5 | NG | E | |
| 9 | 2.3 | 0.5 | 2.5 | 2.5 | 1.5 | NG | E | |
| 10 | 1.5 | 0.2 | 2.5 | 2.5 | 1.5 | G | G | |
| 11 | 1.5 | 0.3 | 2.5 | 2.5 | 1.5 | E | G | |
| 12 | 1.5 | 0.5 | 2.5 | 2.5 | 1.5 | E | E | (1) |
| 13 | 1.5 | 0.7 | 2.5 | 2.5 | 1.5 | G | E | |
| 14 | 1.5 | 0.9 | 2.5 | 2.5 | 1.5 | G | G | |
| 15 | 1.5 | 1.1 | 2.5 | 2.5 | 1.5 | NG | NG | |
| 16 | 1.5 | 1.3 | 2.5 | 2.5 | 1.5 | NG | NG | |
| 17 | 1.5 | 1.5 | 2.5 | 2.5 | 1.5 | NG | NG | |
| 18 | 1.5 | 1.7 | 2.5 | 2.5 | 1.5 | NG | NG | |
| 19 | 1.5 | 0.5 | 2 | 2.5 | 1.5 | NG | G | |
| 20 | 1.5 | 0.5 | 2.3 | 2.5 | 1.5 | E | G | |
| 21 | 1.5 | 0.5 | 2.5 | 2.5 | 1.5 | E | E | (1) |
| 22 | 1.5 | 0.5 | 2.8 | 2.5 | 1.5 | G | E | |
| 23 | 1.5 | 0.5 | 3 | 2.5 | 1.5 | G | G | |
| 24 | 1.5 | 0.5 | 3.2 | 2.5 | 1.5 | NG | NG | |
| 25 | 1.5 | 0.5 | 3.6 | 2.5 | 1.5 | NG | NG | |
| 26 | 1.5 | 0.5 | 2.5 | 1.7 | 1.5 | NG | G | |
| 27 | 1.5 | 0.5 | 2.5 | 1.9 | 1.5 | NG | G | |
| 28 | 1.5 | 0.5 | 2.5 | 2.1 | 1.5 | G | G | |
| 29 | 1.5 | 0.5 | 2.5 | 2.3 | 1.5 | G | G | |
| 30 | 1.5 | 0.5 | 2.5 | 2.5 | 1.5 | E | E | (1) |
| 31 | 1.5 | 0.5 | 2.5 | 2.7 | 1.5 | E | E | (2) |
| 32 | 1.5 | 0.5 | 2.5 | 2.9 | 1.5 | E | G | |
| 33 | 1.5 | 0.5 | 2.5 | 3.1 | 1.5 | E | G | |
| 34 | 1.5 | 0.5 | 2.5 | 3.3 | 1.5 | E | NG | |
| 35 | 1.5 | 0.5 | 2.5 | 2.5 | 0.7 | E | E | (3) |
| 36 | 1.5 | 0.5 | 2.5 | 2.5 | 0.9 | E | G | |
| 37 | 1.5 | 0.5 | 2.5 | 2.5 | 1.1 | E | E | (4) |
| 38 | 1.5 | 0.5 | 2.5 | 2.5 | 1.3 | E | E | (5) |
| 39 | 1.5 | 0.5 | 2.5 | 2.5 | 1.5 | E | E | (1) |
| 40 | 1.5 | 0.5 | 2.5 | 2.5 | 1.7 | G | E | |
| 41 | 1.5 | 0.5 | 2.5 | 2.5 | 1.9 | G | E | |
| 42 | 1.5 | 0.5 | 2.5 | 2.5 | 2.1 | NG | E | |
| 43 | 1.5 | 0.5 | 2.5 | 2.5 | 2.3 | NG | E | |

INK-DROPLET EJECTING APPARATUS

INCORPORATION BY REFERENCE

The present application is based on Japanese Patent Applications Nos. 2005-128107 and 2005-365874, filed on Apr. 26, 2005 and Dec. 20, 2005, respectively, the contents of which are incorporated herein by reference.

BACKGROUND OF THE INVENTION

1. Field of the Invention

The invention relates to an ink-droplet ejecting apparatus of inkjet type.

2. Description of Related Art

There is known an inkjet printer as an ink-droplet ejecting apparatus, which includes an inkjet head that may be of the type including a plurality of ink passages which are defined in the head and each of which includes a pressure chamber and ends at one of a plurality of nozzles open in a surface of the head. The head also includes a plurality of piezoelectric actuators provided for the respective pressure chambers. To eject droplets of ink from each nozzle, an electrical drive signal in the form of pulses forming a specific waveform is applied to each of the actuators to deform the actuator, thereby pressurizing the ink in the pressure chambers to eject ink droplets as desired.

When a pulse is applied to each actuator, a pressure wave occurs in the ink in the corresponding pressure chamber, and propagates along the ink passage. The time that the pressure wave occurring in the pressure chamber takes to propagate one way along the ink passage, or in a longitudinal direction of the ink passage, from one of opposite ends of the ink passage to the other end thereof, will be referred to as a one-way propagation time AL. For instance, the ink passage may extend from a common ink chamber to a nozzle via the pressure chamber. In this case, an end of the ink passage is at the nozzle, and the other end of the ink passage is at one of the opposite ends of the common ink chamber on the side of the nozzle. However, when the pressure chamber and the nozzle are connected to each other via a thin communication hole or the like, the one end of the ink passage may be at an end of the thin communication hole or the like on the side of the pressure chamber, and when the pressure chamber and the common ink chamber are connected to each other via a thin connecting passage or a restricting portion, the other end of the ink passage may be at an end of the thin connecting passage or restricting portion on the side of the pressure chamber. To maximize the energy efficiency of an ink-droplet ejection and the volume of the ejected ink droplet, a pulse width of the pulse is made the same as the one-way propagation time AL.

Meanwhile, an inkjet printer performs recording of an image on a recording medium, typically by ejecting toward the recording medium ink droplets of various volumes to print dots of various sizes, or recording areas, on the recording medium. In other words, the volume of each droplet corresponding to one dot is required to be changeable or selectable. For instance, a waveform of a drive signal for printing a single dot is determined to be a series of a plurality of pulses, so that the single dot is formed by a plurality of ink droplets, or so that a part of an ink droplet beginning to get off of the nozzle is pulled back to reduce the printed dot. Further, in some cases, a stabilizing pulse or a cancelling pulse is applied subsequent to a main pulse that is for ejecting an ink droplet, in order to suppress or damp a vibration or pulsation remaining in the ink after the ejection of the ink droplet from adversely affecting the following ejection.

JP-B2-3551822, which is publication of a patent granted for the present applicant, discloses a way of increasing the volume of an ink droplet, or the size of a dot. That is, a first ink droplet is initially ejected, but before the first ink droplet completely gets off, or leaves, the nozzle, ejection of a second ink droplet is initiated, so that a single larger ink droplet formed by coalescence of the two ink droplets is ejected onto the recording medium. More specifically, according to a technique disclosed in the publication, a drive signal includes a first pulse, a second pulse as a main pulse, and a third pulse, that are sequentially applied in this order to constitute one set of pulses. A pulse width of the main pulse (or the second pulse) is the same as, and synchronized with, a one-way propagation time T (corresponding to the above-mentioned one-way propagation time AL) of a pressure wave, and a pulse width of the first pulse is 0.35 T-0.65 T. The third pulse is applied to a purpose other than for ejecting an ink droplet, and a pulse width of the third pulse is relatively small. Thus, the first pulse is initially applied in order to eject a first ink droplet at low energy efficiency, but before the first ink droplet completely gets off a nozzle, the second pulse is applied to eject a second ink droplet at high energy efficiency to form a coalescent ink droplet of a large volume, Then, the third pulse is applied in order to damp a residual component of the pressure wave in the ink passage.

On the other hand, there are known three ways of decreasing the volume of an ink droplet. A first way is that a pulse width of the main pulse (or the second pulse) of the drive signal is made different from the one-way propagation time AL in order to purposely lower the energy efficiency of the ink droplet ejection, thereby reducing the volume of the ink droplet. A second way, which is disclosed in JP-A-11-170515, is that a first ink droplet is initially ejected, but when the first ink droplet partially gets off the nozzle, a second pulse is applied at a timing to pull back the first ink droplet, thereby reducing the volume of the ink droplet. The third way of decreasing the volume of an ink droplet is disclosed in JP-A-11-227203 (see especially FIG. 2 and paragraphs 0027 and 0028), where a main or ejection pulse, a volume-reducing pulse, and a stabilizing pulse are applied in this order in a single cycle, and the driving of the head is performed at a frequency of 10 kHz.

However, when the volume of an ink droplet is to be decreased by either of the above-described methods, the speed at which the ink droplet is ejected (which may be referred to as "ejection speed" hereinafter) lowers. When the two methods are employed in combination in order to considerably decrease the volume of an ink droplet, the ejection speed further lowers. The lowering in the ejection speed deviates the landing position of the ink droplet, i.e., the position of the printed dot on the recording medium, from a desired position. That is, the decrease in the ejection speed lowers the accuracy in the landing position of the ink droplet.

Recently, there has been a demand for enhancing the recoding rate of the inkjet printers, in turn demanding to enhance the frequency of the driving the actuators. That is, a drive cycle time for forming one dot has been required to be decreased. In a technique where the ejection pulse is applied at the beginning of each drive cycle time, like the technique disclosed in the above-mentioned publication JP-A-11-227203, a single pulse, namely, the ejection pulse, should generate sufficiently great energy to eject a droplet. Hence, a pulse width of the ejection pulse is required to be synchronized with the pressure wave occurring in the ink in order to generate a great pressure by superimposing the ejection pulse on the pressure wave. Further, the stabilizing pulse for damping the great pressure should be applied with a sufficiently large interval from the ejection pulse, in a sufficiently large pulse width. Hence, an entire length of a single drive signal including a plurality of pulses becomes relatively large, thereby making the drive cycle time long and making it impossible to enhance the recording rate.

To shorten the drive cycle time, it is necessary to shorten the one-way propagation time AL, which is a time taken by the pressure wave caused in the ink upon a deformation of the piezoelectric actuator to propagate one way along the ink passage, and which is a factor determining the pulse width of each of the plural pulses of one drive cycle time. Although this can be achieved by decreasing a length of the ink passage including the pressure chamber, the decrease in the length of the ink passage involves decrease in the pressure chamber, resulting in increase in a drive voltage applied to the piezoelectric actuator in order to produce the ejection pressure of the same level as in the past. However, the increase in the drive voltage is limited.

SUMMARY OF THE INVENTION

The present invention has been developed in view of the above-described situations, and it is therefore an object of the invention to provide an ink-droplet ejecting apparatus that can eject an ink droplet of a small volume at a sufficiently high speed in order not to lower the accuracy in the landing position of the ink droplet, while decreasing the entire length of the drive signal to shorten the drive cycle time, thereby enhancing the recording rate.

To attain the above object, the invention provides an ink-droplet ejecting apparatus including: a plurality of ink passages each of which includes a pressure chamber filled with ink; a plurality of actuators each of which is operated to change, upon receiving a drive signal, an inner volume of one of the pressure chambers to generate a pressure wave in the ink in the pressure chamber which wave propagates along the ink passage to eject a droplet of the ink onto a recording medium; and a control unit which is connected to the plurality of actuators and supplies the drive signal to the actuators such that the drive signal is in one of at least one waveform including a waveform which is for forming a single dot on the recording medium and includes (i) a main pulse for ejecting the droplet, (ii) a preceding pulse outputted before the main pulse, and (iii) a stabilizing pulse outputted after the main pulse, a pulse width of the main pulse being not coincident with a one-way propagation time AL which is a time taken by the pressure wave to propagate one way along the ink passage, the preceding pulse being outputted in a manner not to eject the droplet, and the stabilizing pulse being outputted in a manner to pull back a part of the droplet as beginning to be ejected by the main pulse.

According to this apparatus, the pulse width Tm of the main pulse Pm is not coincident with the one-way propagation time AL to intentionally lower the efficiency of ejection of an ink droplet, so that the volume of the ink droplet ejected upon application of the main pulse Pm is reduced. Further, a part of the ink droplet as beginning to be ejected by the main pulse Pm is pulled back by application of the stabilizing pulse Ps, the size of the ink dot formed on the recording medium by the ink droplet can be made small. In addition, the preceding pulse Pp that can not singly completely eject an ink droplet is first applied to the actuator, in order to pressurize the ink in the pressure chamber prior to application of the main pulse Pm. In other words, the main pulse Pm is applied when a pulsation or pressure wave is already caused in the ink in the pressure chamber by the preceding pulse Pp. Hence, at the time when the main pulse Pm is applied, the ink is in a state such that a droplet thereof is easily ejected. Thus, even when the efficiency of ejection of the ink droplet by application of the main pulse Pm is relatively low, the ink droplet can be quickly ejected, at a speed not greatly lowered. Hence, even though the volume of the ink droplet is decreased, the ejection speed and accordingly the accuracy in the landing position does not lower. Application of the stabilizing pulse Ps at the last makes it possible to damp the remaining pressure wave in order to prevent the pressure wave from affecting the subsequent drive pulse, while the volume of the ink droplet is reduced.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 9 is a table showing a result obtained in an experiment conducted for optimizing the drive signal; and FIG. 10 is a table showing a result obtained in another experiment conducted for optimizing the drive signal.

DETAILED DESCRIPTION OF PREFERRED EMBODIMENTS

Hereinafter, by referring to the accompanying drawings, there will be described an ink-droplet ejecting apparatus according to one embodiment of the invention, which takes the form of an inkjet printer.

The inkjet printer includes an inkjet head 100 that is mounted in a carriage (not shown) reciprocated in a main scanning direction that will be hereinafter referred to as "the Y-axis direction". The main scanning direction is perpendicular to a feeding direction that is a direction in which a recording medium is fed, i.e., a sub scanning direction that will be hereinafter referred to as "the X-axis direction". Inks of respective colors, e.g., cyan, magenta, yellow, and black, are supplied into the inkjet head 100. Ink cartridges containing the respective color inks are detachably mounted on the carriage, or alternatively the ink cartridges are fixed in position in a mainbody of the inkjet printer, and the inks are supplied to the inkjet head 100 through respective supply pipes or the like.

Figure 1:
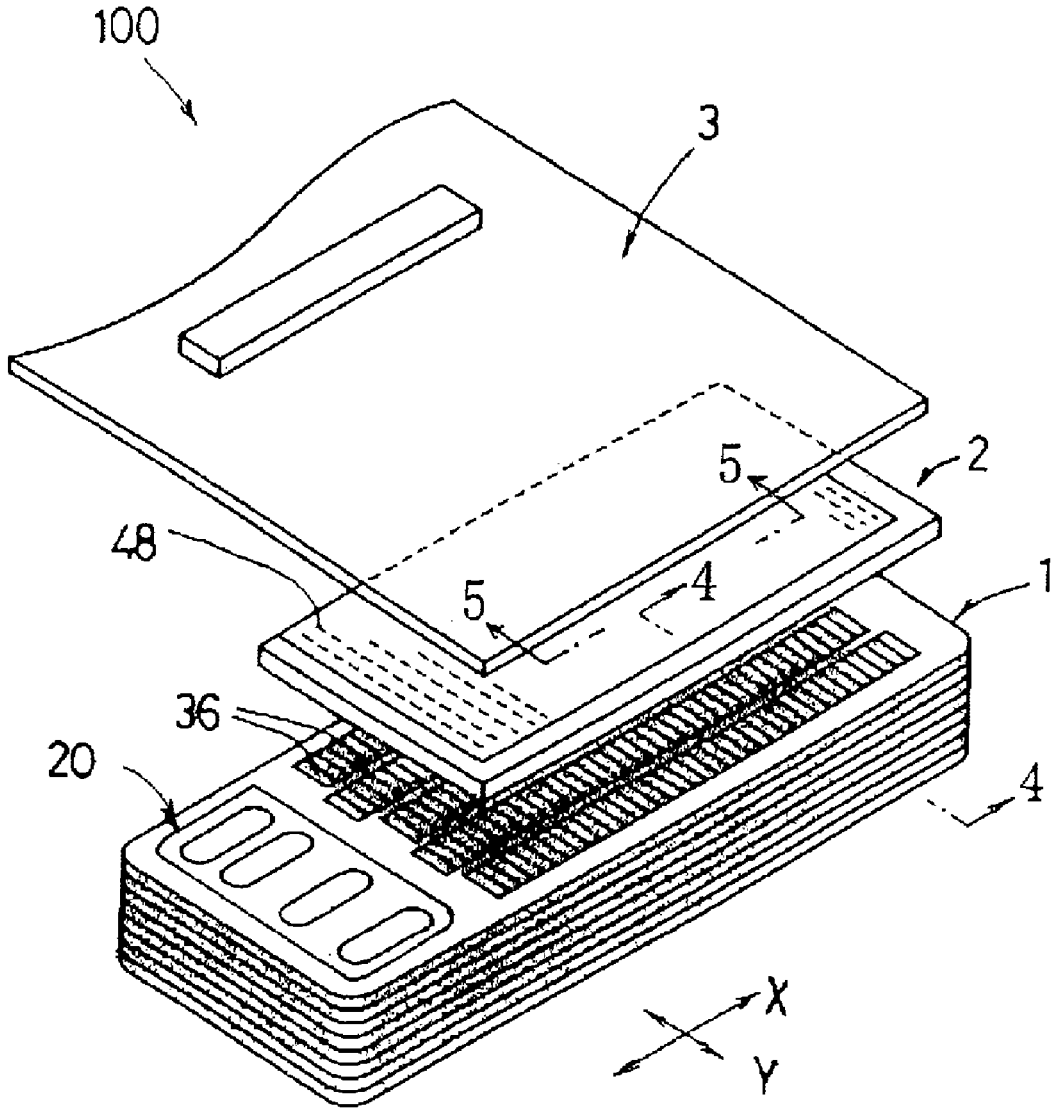
FIG. 1 is a perspective view of an inkjet head in an ink-droplet ejecting apparatus, according to one embodiment of the invention.

As shown in FIG. 1, the inkjet head 100 includes a cavity unit 1 formed of a plurality of metallic plates, and a planar piezoelectric actuator unit 2. The cavity unit 1 and the actuator unit 2 are bonded to each other. A flexible flat cable 3 (shown in FIGS. 3 and 4) is superposed on and bonded to an upper or back surface of the planar piezoelectric actuator unit 2, in order to establish connection with an external device. A plurality of nozzles 4 are formed in the cavity unit 1 to open in a lower or front surface of the cavity unit 1, so that droplets of the inks are ejected downward.

Figure 2:
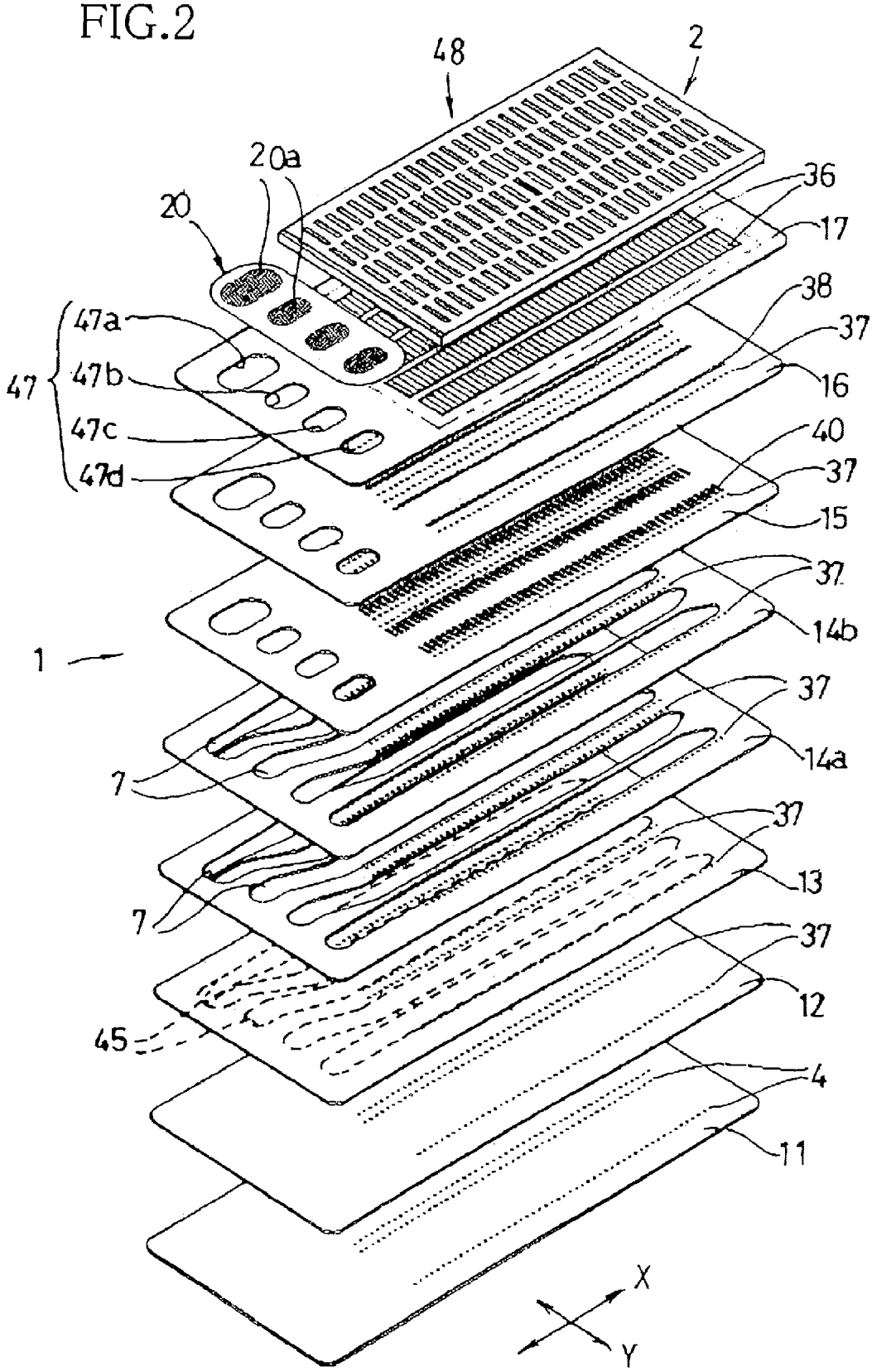
FIG. 2 is an exploded perspective view of the inkjet head.

There will be described a structure of the cavity unit 1. As shown in FIG. 2, the cavity unit 1 is formed by stacking and bonding with an adhesive eight thin plates one on another The eight thin plates are a nozzle plate 11, a spacer plate 12, a damper plate 13, two manifold plates 14*a*, 14*b*, a supply plate 15, a base plate 16, and a cavity plate 17.

In this specific example, each of the plates 11-17 has a thickness of about 50-150 μm, and the nozzle plate 11 is made of synthetic resin such as polyimide, and the other plates 12-17 are formed of a nickel alloy steel sheet containing 42% of nickel. A plurality of the nozzles 4 for ejecting ink droplets therefrom are formed through the nozzle plate 11, and arranged at very small intervals. Each of the nozzles 4 has a diameter as small as about 25 μm. The nozzles 4 are arranged in five rows each extending along a longitudinal direction of the nozzle plate 11 that is parallel to the X-axis direction.

Figure 3:
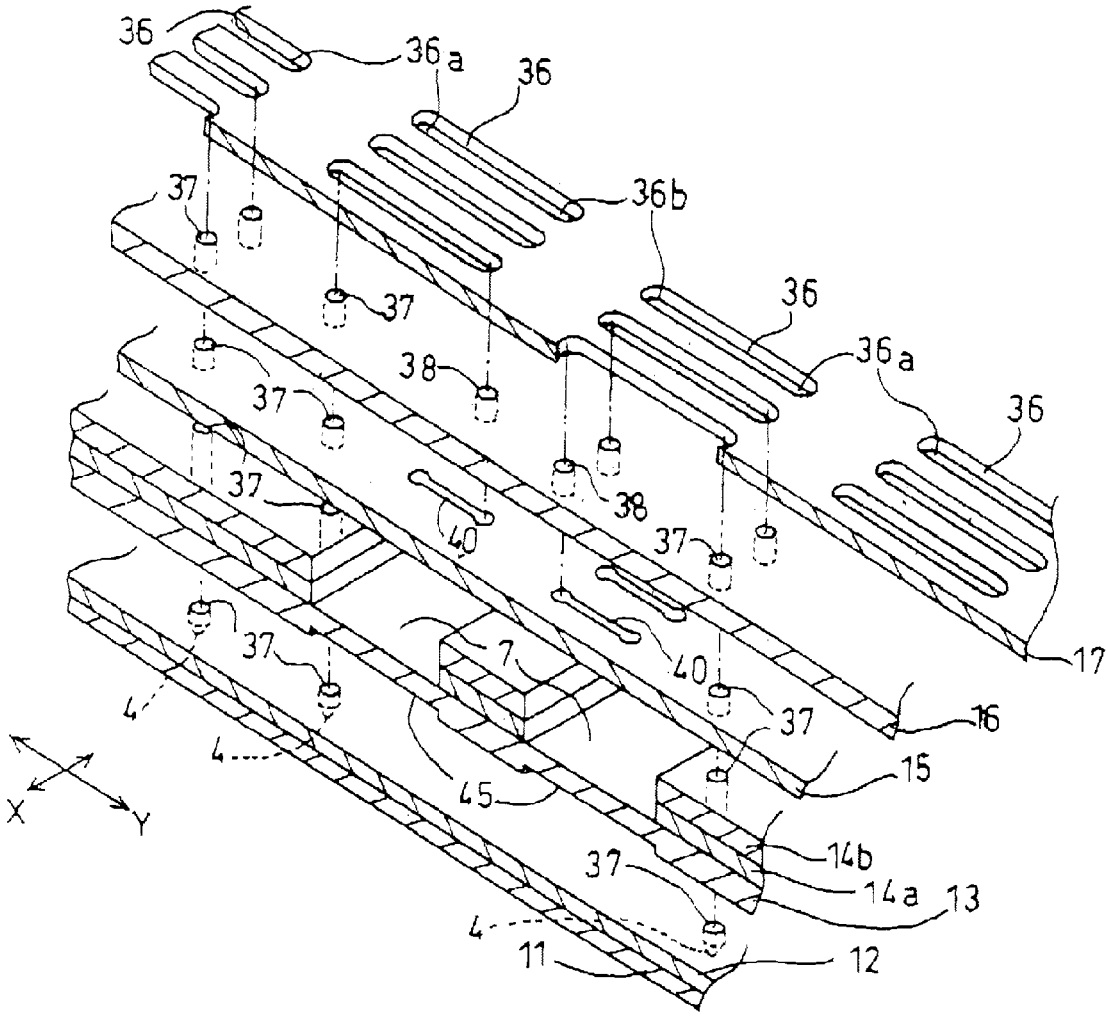
FIG. 3 is an exploded perspective view showing in enlargement a cavity unit constituting a part of the inkjet head.

As shown in FIG. 3, a plurality of through-holes are formed in the cavity plate 17 to serve as a plurality of pressure chambers 36. The pressure chambers are arranged in five rows each extending along a longitudinal direction of the cavity plate 17 that is parallel to the X-axis direction. In this specific example, each of the pressure chambers 36 is elongate in plan view and a longitudinal direction of the pressure chamber is parallel to the shorter sides of the cavity plate 17 that are parallel to the Y-axis direction, so that one 36*a* of two opposite longitudinal ends of the pressure chamber 36 is in communication with one of the nozzles 4, and the other longitudinal end 36*b* of the pressure chamber 36 is in communication with one of a plurality of common ink chambers 7 described later.

The longitudinal end 36*a* of the pressure chamber 36 is communicated with the nozzle 4 formed through the nozzle plate 11, via a communication hole 37 of small diameter extending through the supply plate 15, the base plate 16, the two manifold plates 14*a*, 14*b*, the damper plate 13, and the spacer plate 12.

A plurality of through-holes are formed in the base plate 16 that is immediately under the cavity plate 17, and communicated with the respective ends 36*b* of the pressure chambers 36.

A plurality of through-holes to serve as connecting passages 40 for supplying the inks from the common ink chambers 7 (described later) to the pressure chambers 36 are formed through the supply plate 15 that is immediately under the base plate 16. Each of the connecting passages includes an inlet, an outlet, and a restricting portion therebetween. The ink in the common ink chamber 7 is introduced into the connecting passage through the inlet, then passes through the restricting portion having a smaller cross-sectional area than the inlet and outlet in order to have the highest resistance to the ink flow in the connecting passage, and then goes out of the connecting passage through the outlet that opens into the through-hole 38 that is connected to the pressure chamber 36.

Figure 4:
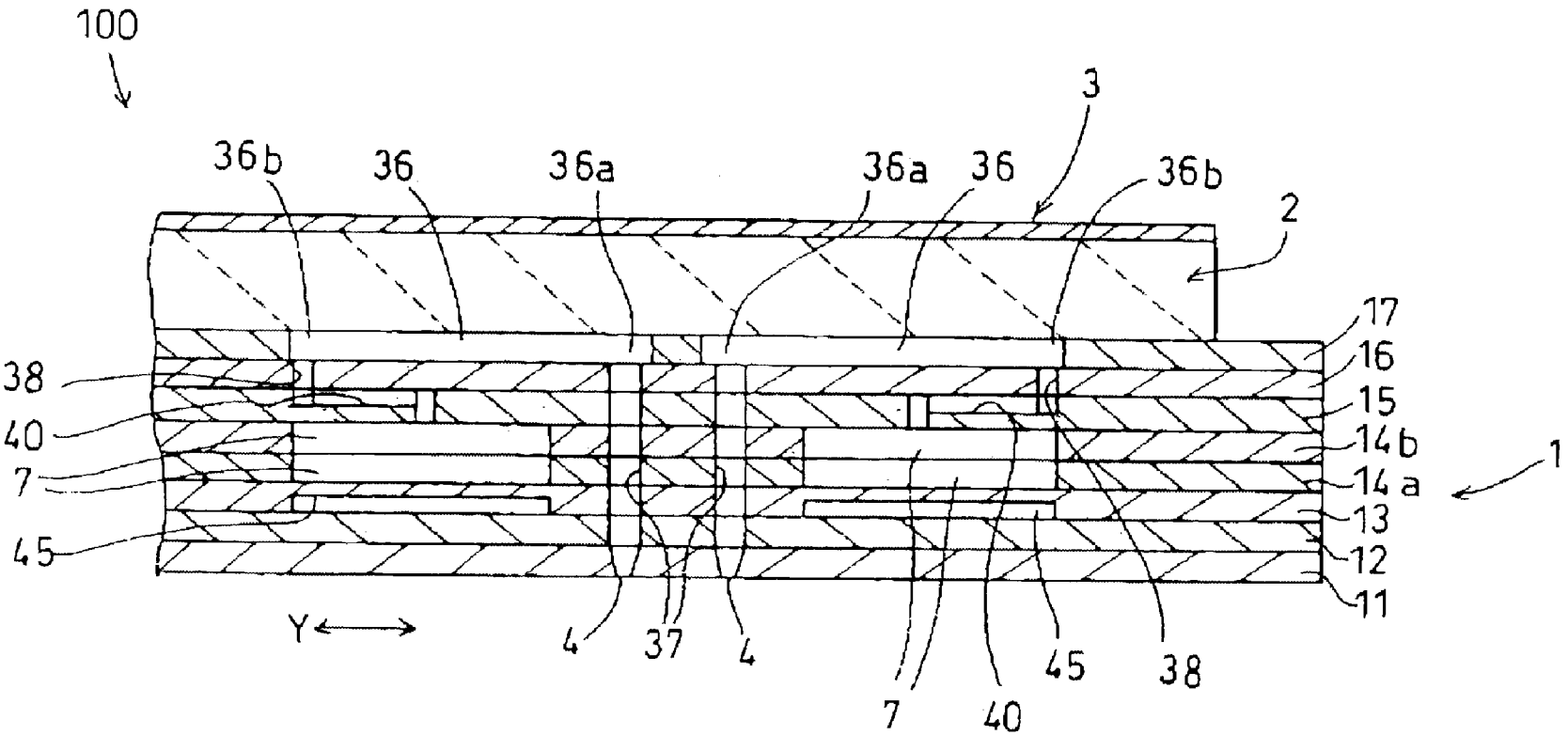
FIG. 4 is an enlarged cross-sectional view taken along line 4-4 in FIG. 1.

Five elongate through-holes to serve as common ink chambers 7 are formed through the two manifold plates 14*a*, 14*b* and extend along a longitudinal direction of the two manifold plates 14*a*, 14*b*, that is parallel to the X-axis direction. Positions of the common ink chambers 7 correspond to the rows of the nozzles 4. As shown in FIGS. 2 and 4, the two manifold plates 14*a*, 14*b* are stacked and an upper surface and a lower surface of the stack are covered with the supply plate 15 and the damper plate 13, respectively. In this way, closed common ink chambers 7 (or manifold chambers) five in total are formed. When seen in a direction of stacking of the plates 11-17, each common ink chamber 7 overlaps a part of one of rows of the pressure chambers 36, and extends along the row of the pressure chambers 36 or the nozzles 4.

As shown in FIGS. 3 and 4, on a lower surface the damper plate 13 that is immediately under the manifold plate 14*a*, there are formed five recesses to serve as damper chambers 45 not in communication with the common ink chambers 7. As shown in FIG. 2, the positions and shapes of the damper chambers 45 are coincident with those of the common ink chambers 7. The damper plate 13 is made of a metallic material capable of elastic deformation, and a thin ceiling portion over the damper chamber 45 can freely vibrate to both of the opposite sides, namely, the side of the common ink chamber 7 and the side of the damper chamber 45. Upon ejection of an ink droplet, a pressure change occurs in the corresponding pressure chamber 36, and propagates to the common ink chamber 7. At this time, the ceiling portion exhibits a damping effect, namely, elastically deforms or vibrates to absorb or attenuate the pressure change. This arrangement of the damper chambers 45 is made for reducing the crosstalk, i.e., propagation of a pressure change occurring in a pressure chamber 36 to another pressure chamber 36.

As shown in FIG. 2, four ink supply ports 47 are formed through the cavity plate 17, the base plate 16, and the supply plate 15, at one of two opposite shorter sides thereof. Namely, four through-holes are formed in each of these plates 15-17. The four through-holes formed in the respective plates 15-17 are vertically aligned when the plates 15-17 are stacked, thereby forming the four ink supply ports 47. The inks in an ink supply source, i.e., the ink cartridges, are supplied through the ink supply ports 47 into end portions of the respective common ink chambers 7. The four ink supply ports are respectively denoted by reference symbols 47*a*, 47*b*, 47*c*, and 47*d*, from left to right as seen in FIG. 2.

Thus, a plurality of ink paths each beginning from one of the ink supply ports 47 and one of the nozzles 4 are formed. An ink introduced from one of the ink supply ports 47 into the corresponding common ink chamber 7 as an ink supply channel is distributed to the pressure chambers 36 via the connecting passages formed through the supply plate 15 and the through-holes 38 formed through the base plate 16, as shown in FIG. 3. As fully described later, by driving the piezoelectric actuator unit 2, the ink in each pressure chamber is selectively flown to the nozzle 4 through the communication hole 37. That is, by driving the piezoelectric actuator unit 2 as described later, a pressure is applied to the ink in the pressure chamber 36, and a pressure wave occurring in the pressure chamber 36 propagates to the nozzle 4 through the communication hole 37, thereby ejecting a droplet of the ink.

In the present embodiment, as shown in FIG. 2, the number of the supply ports 47 are four while the number of the common ink chambers 7 are five. That is, one 47*a* of the ink supply ports 47 is connected to two common ink chambers 7, 7. To the ink supply port 47*a* is supplied the black ink that is most frequently used in the four color inks. To the other ink supply ports 47*b*, 47*c*, and 47*d*, the yellow, magenta, and cyan inks are respectively supplied. A filter member 20 (shown in FIG. 1) having four filtering portions 20*a* is attached, with an adhesive or otherwise, to the cavity unit 1 such that the filtering portions 20*a* respectively cover the ink supply ports 47*a*, 47*b*, 47*c*, and 47*d*.

Figure 5:
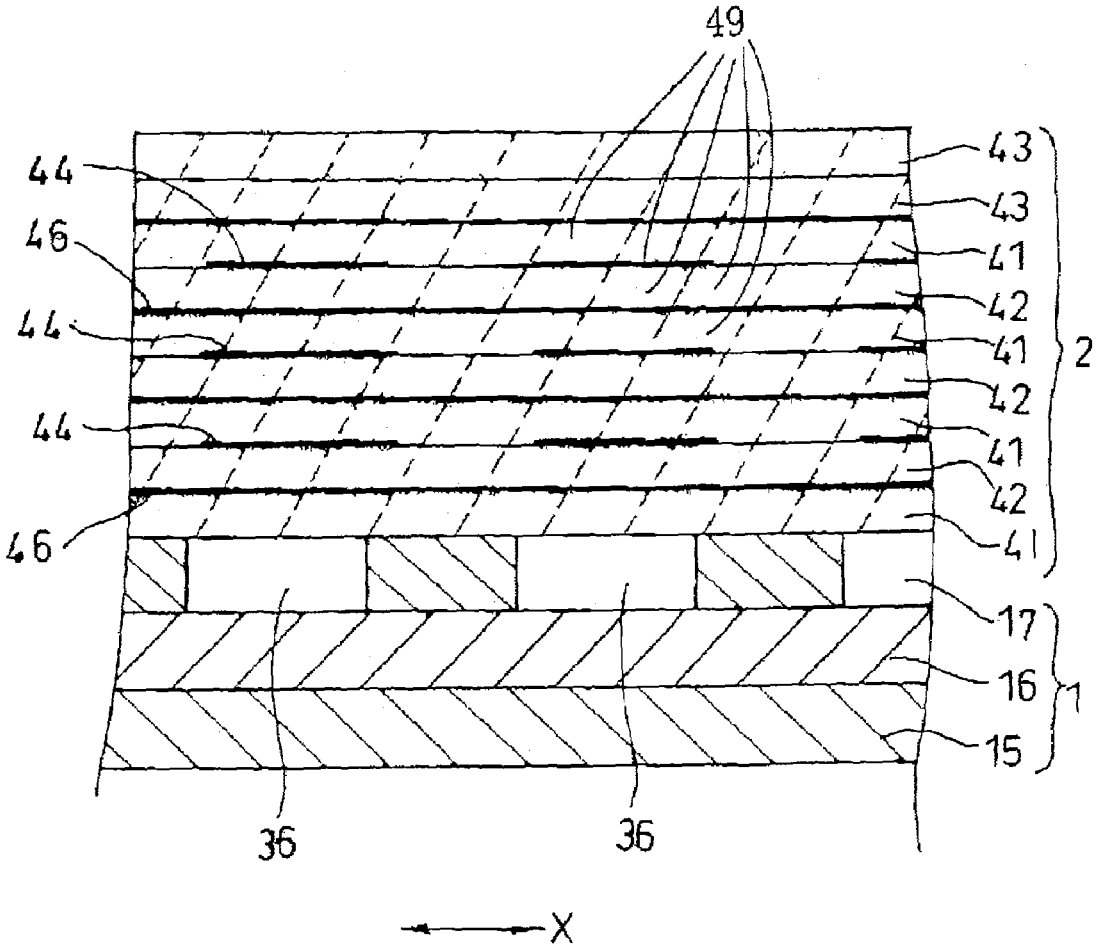
FIG. 5 is an enlarged cross-sectional view taken along line 5-5 in FIG. 1.

There will be described a structure of the piezoelectric actuator unit 2, which is similar to that disclosed in JP-A-4-341853 or JP-A-2002-254634, for instance. That is, as shown in FIG. 5, a plurality of piezoelectric sheets 41-43 each having a thickness of about 30 μm are stacked such that each evennumbered piezoelectric sheets 42 as counted from the bottom has on its major surface or an upper surface a plurality of elongate individual electrodes 44. The individual electrodes 44 are arranged in rows each extending along a longitudinal direction of the actuator unit 2 that is parallel to the Y-axis direction, so that positions of the respective individual electrodes 44 correspond to those of the pressure chambers 36 in the cavity unit 1. Each odd-numbered piezoelectric sheets 41 as counted from the bottom has on its major surface or upper surface a plurality of common electrodes 46 each for a plurality of the pressure chambers 36. On an upper surface of a topmost one 43 of the piezoelectric sheets, there are disposed a plurality of surface electrodes 48 connected to the individual electrodes respectively positionally corresponding thereto via electrical through-holes or others, and a plurality of surface electrodes connected to the respective common electrodes via electrical through-holes or others.

As well known in the art, a high voltage is applied between the individual electrodes 44 and the common electrodes 46 to polarize a portion 49 of the piezoelectric sheets between the individual electrodes 44 and the common electrodes 46, to make the portion function as an active portion 49 or an actuator.

The cavity unit 1 and the piezoelectric actuator unit 2 prepared as described above are bonded to each other as follows. An adhesive sheet (not shown) made of ink-impervious synthetic resin is attached to a lower surface of the planar piezoelectric actuator unit 2, which surface is a major surface to be opposed to the pressure chambers 36, to cover an entirety of the lower surface. Then, the piezoelectric actuator unit 2 is positioned relative to the cavity unit 1 such that the individual electrodes 44 in the actuator unit 2 are opposed to the pressure chambers 36 in the cavity unit 1, and bonded or fixed thereto. The above-mentioned flexible flat cable 3 is superposed on and pressed against an upper surface of the piezoelectric actuator unit 2, and various wiring patterns (not shown) on the flexible flat cable 3 are electrically connected to the surface electrodes.

Figure 6:
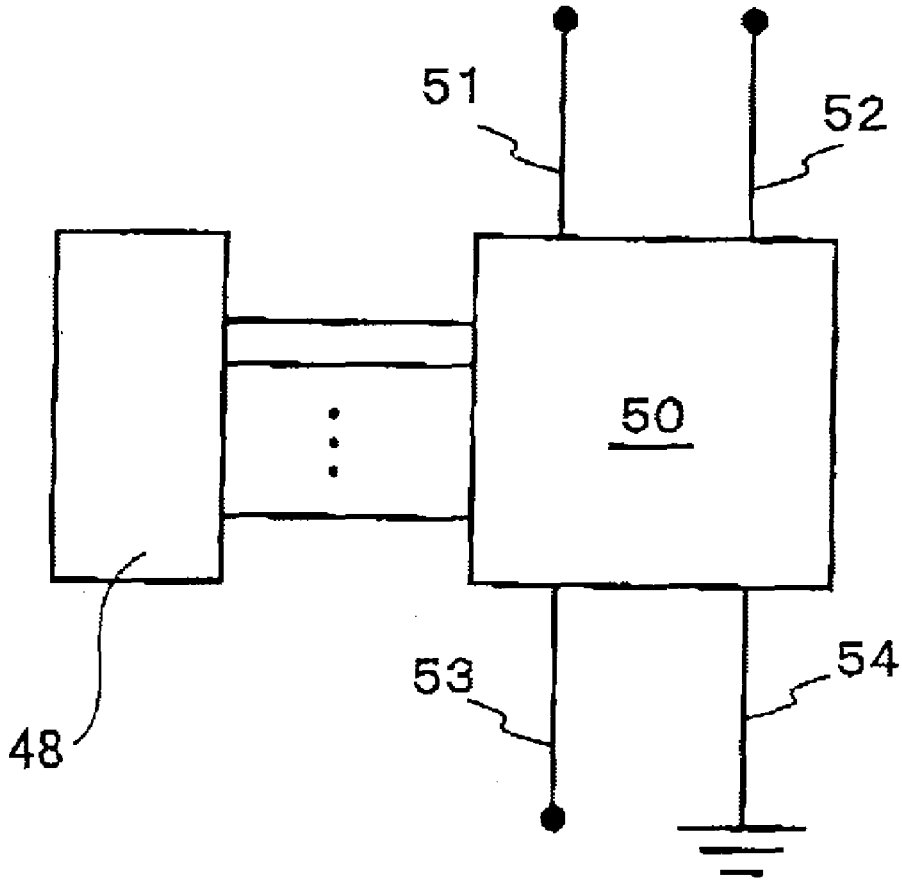
FIG. 6 is a block diagram of a control unit of the ink-droplet ejecting apparatus.

There will be described a structure of a control unit for controlling a drive voltage applied to each electrode, by referring to FIG. 6. In this embodiment, the control unit is constituted by a LSI chip 50 (shown in FIG. 1) as a driver. The LSI chip 50 is disposed on the flexible flat cable 3. The surface electrodes corresponding to the individual electrodes 44 and common electrodes 46 are connected to the LSI chip 50. To the LSI chip 50 are also connected a clock line 51, a data line 52, a voltage line 53, and an earth line 54. In synchronization with the clock pulse supplied from the clock line 51, data corresponding to each nozzle 4 is serially supplied onto the data line 52. Data representative a plurality of kinds of drive signals can be supplied through the voltage line 53 from a circuit (not shown) in the mainbody of the inkjet printer. A selection of the kind of the drive signals is made among the plurality of kinds based on the above-mentioned serial data, and a drive signal of the selected kind at a voltage suitable for driving the active portion 49 is generated. The ink in the pressure chamber 36 corresponding to this active portion 49 is applied with a pressure to produce a pressure wave in order to eject the ink droplet. An advancing component in the pressure wave, i.e., a portion of the pressure wave propagating from the pressure chamber to the nozzle 4, ejects the ink from the nozzle 4 in the form of a droplet.

Figures 7A, 7B:
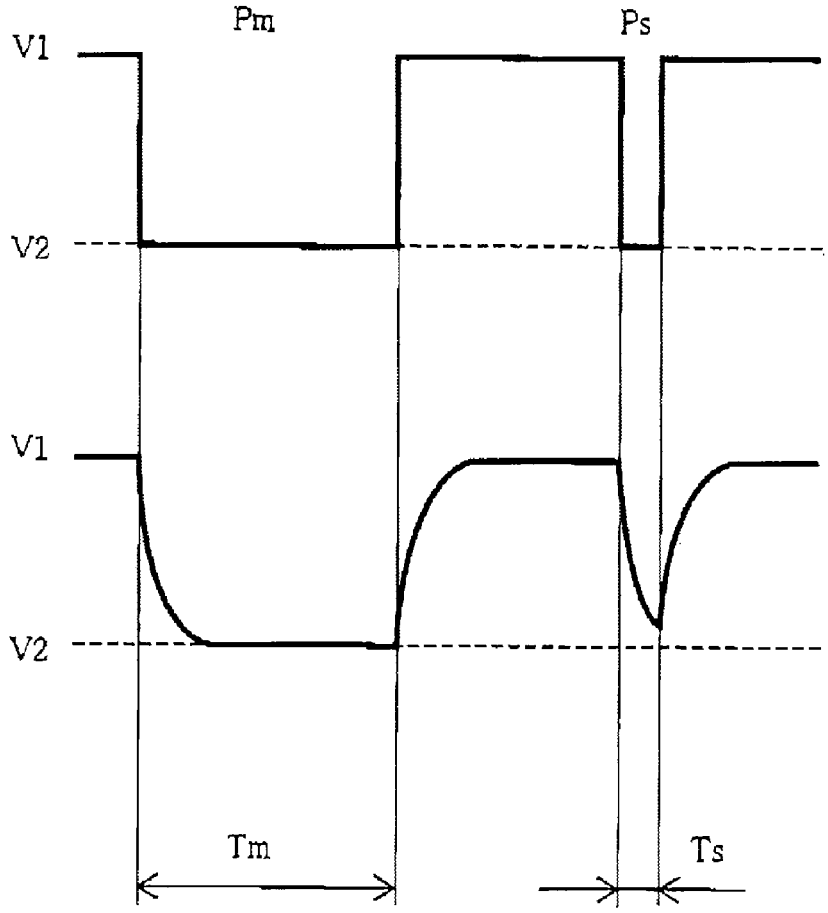
FIGS. 7A and 7B are diagrams illustrating a relationship between pulse width and voltage of a drive signal according to the embodiment.

As shown in FIG. 7A, the drive signal is formed by varying the voltage between a first value V1 and a second value V2 to form a plurality of pulses arranged in a specific waveform. In this specific example, the first value V1 is a positive value, and the second value V2 is zero. Prior to ejection of an ink droplet, all the individual electrodes 44 are applied with the voltage of the positive value V1, and the common electrodes 46 are grounded, thereby expanding all the active portions 49 between the individual electrodes 44 and common electrodes 46, and thus decreasing the inner volume of all the pressure chambers 36. When the application of the voltage at the first value V1, in the direction of stacking of the piezoelectric sheets 41-43, to the individual electrodes 44 corresponding to one of the pressure chambers 36 from which the ink is to be ejected is stopped, that is, when the value of the voltage applied to that pressure chamber 36 is switched from V1 to V2, the active portion 49 restores to its contracted state to increase the inner volume of the pressure chamber. This makes the inner pressure of the pressure chamber 36 or the pressure of the ink in the pressure chamber 36 decreases to be negative, thereby generating a pressure wave. At a timing when the pressure of the pressure wave inverts to be positive, the individual electrodes 44 are again applied with the voltage of the value V1, in order that the pressure generated by the expansion of the active portion 49 is added to the pressure of the pressure wave inverting, thereby ejecting a droplet of the ink from the corresponding nozzle 4.

As described above, the pulses are variation in the voltage between the predetermined values V1 and V2. However, there occurs a delay at each rising and falling edge in the waveform, as shown in FIG. 7B. This results from that the piezoelectric layer between the individual electrode 44 and the common electrode 46 functions as a condenser, and the electrical path from the control unit or LSI chip 50 that outputs the drive signal to the individual electrode 44 has a resistance, so that when the control unit outputs the square waveform signal as the drive signal, an integrating circuit is formed by the condenser and the resistance, thereby causing a rounding or a lag at each rising edge and falling edge in the waveform, at the individual electrode 44. Therefore, a pulse width Tm of a main pulse Pm is determined to be sufficiently large to include the time corresponding to the lag, in order to change the voltage from V1 down to V2. On the other hand, a pulse width Ts of a stabilizing pulse Ps is determined to be sufficiently small in order to change the voltage from V1 only down to a value above V2. That is, at the stabilizing pulse, an amount by which the voltage applied to the active portion 49 is changed or decreased is smaller than that at the main pulse Pm.

Thus, the stabilizing pulse Ps has a relatively small pulse width Ts that is determined so that the voltage applied to the active portion 49 does not change to reach the second value V2 from the first value V1. This is effective to reduce the fatigue of the active portion 49 and the heat generated thereby, while shortening the length of the drive signal formed of a plurality of pulses as a whole, thereby enhancing the frequency of driving the active portions 49 and accordingly the recording rate.

The way of ejecting an ink droplet may be inversely modified such that a voltage is applied to a drive electrode to increase the inner volume of the pressure chamber to generate a pressure wave, and application of the voltage is stopped at the timing when the propagating direction of the pressure wave inverts, to decrease the inner volume of the pressure chamber to eject the ink droplet, as disclosed in JP-A-2001-301161.

Thus, each of three pulses Pp, Pm, Ps forming the drive signal is applied to first increase and then decrease the inner volume of the pressure chamber 36. This makes it possible to eject a droplet of the ink upon application of the main pulse Pm after a preceding pulse Pp has produced a pulsation in the ink in the pressure chamber 36, even where the pulse width Tm of the main pulse Pm is relatively small with respect to a cycle time of the pressure wave. Further, this makes it possible to well pull back a part of the ink droplet as beginning to be ejected and damp the pulsation remaining in the ink in the pressure chamber 36 upon application of the stabilizing pulse Ps after an interval from the main pulse Pm, even where the interval is relatively small. Thus, an entire length of the drive signal formed of a plurality of pulses is reduced to enhance the frequency of driving the active portions 49, thereby enabling to enhance the recording rate, while a part of the ink droplet beginning to be ejected is well pulled back to reduce the volume of the ink droplet with high accuracy.

Figure 8:
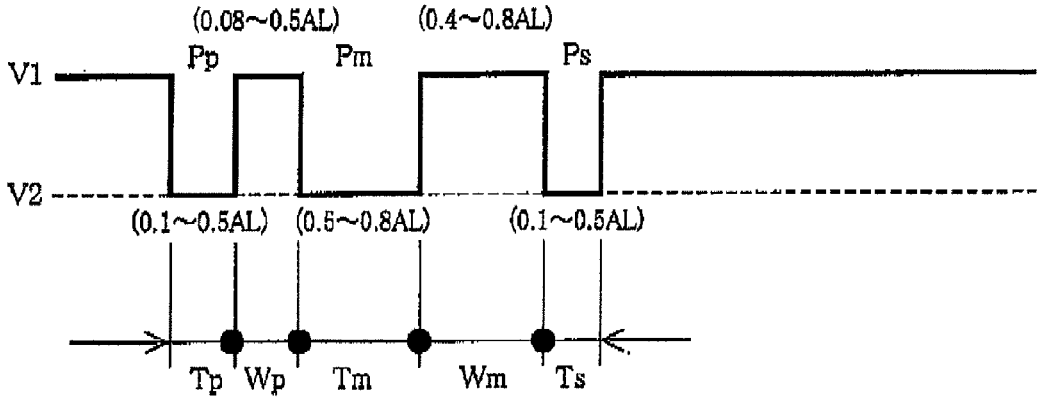
FIG. 8 is a diagram illustrating a waveform of the drive signal.

In the inkjet printer incorporating the thus constructed inkjet head 100, data of a plurality of kinds of the drive signals for ink droplets of respective volumes are set, in order to enable gray-scale presentation, or formation of various sizes (i.e., areas or diameters) of dots on the recording medium. That is, the volume of ejected ink droplets can be controlled dot by dot. When a dot size or diameter is controlled, the number of pulses of the drive signal for ejecting an ink droplet is controlled, namely, increased or decreased, as well known in the art. FIG. 8 shows a drive signal for ejecting one ink droplet of a volume smaller than that of one ink droplet ejected by a single usual pulse. Hereinafter, the ink droplet of the smaller volume will be referred to as "small droplet".

As shown in FIG. 8, a waveform for forming one small droplet includes three pulses Pp, Pm, Ps. Each of the pulses is applied to the active portion 49 in order to first increase the inner volume of the pressure chamber 36 and then decreases the inner volume.

The time the pressure wave takes from its generation to turn positive is determined by a one-way propagation time AL that is a time the pressure wave takes to propagate through the ink passage for each nozzle 4 including the pressure chamber 36, the communication hole 37, and the through-hole 38. The one-way propagation time AL is determined by various factors including not only the natural vibration frequency of the ink and the length of the ink passage, but also a resistance of the ink passage to the ink flow and a rigidity of each of the plates defining the ink passages.

That is, the time period from a falling edge to a rising edge (as seen in FIG. 8, i.e., "the falling edge" is the place where the voltage changes from V1 to V2) of the main pulse Pm of the drive signal i.e., the pulse width Tm of the main pulse Pm, is made coincident with the one-way propagation time AL of the pressure wave, in order to maximize the pressure of the pressure wave to which the positive pressure produced upon the expansion of the active portion 49 is added, thereby maximizing the energy efficiency in the ink droplet ejection, that is, the ejection speed becomes the highest, and the volume of the ejected ink droplet is the largest. Since the present embodiment has been developed for the purpose of ejecting an ink droplet smaller in volume than standard, the pulse width Tm of the main pulse Pm is made smaller than the one-way propagation time AL, that is, Tm<AL, in order to intentionally lower the energy efficiency of the ink droplet ejection.

The lower energy efficiency in ejecting an ink droplet by applying the main pulse Pm means a lower speed of the thus ejected droplet. The lower ejection speed causes an error in the position where the ejected ink droplet reaches on the recording medium, or lowering in the accuracy of the landing position. Hence, prior to the main pulse Pm, there is applied the preceding pulse Pp that has a pulse width Tp smaller than the pulse width Tm of the main pulse Pm so that the applying singly the preceding pulse Pp does not cause ejection of an ink droplet. More specifically, the pulse width Tp of the preceding pulse Pp is determined not to eject an ink droplet while the ink in the ink passage is substantially still, i.e., while substantially no pulsation is in the ink, and the preceding pulse Pp is for generating a pulsation or a pressure wave prior to application of the following main pulse Pm. In other words, when the main pulse Pm is applied, a pulsation has already occurred in the ink, and the ink is ready to be ejected. The main pulse Pm is added to the pressure wave already generated by the preceding pulse Pp to produce a greater pressure wave, that can eject an ink droplet from the nozzle 4 at a speed not lowered.

Following the main pulse Pm, the stabilizing pulse Ps is applied at a timing when the ink droplet begins to be ejected from the nozzle 4 by the main pulse Pm, and has not yet gotten off the nozzle 4. A pulse width Ts of the stabilizing pulse Ps is relatively small such that applying only the stabilizing pulse Ps to the active portion 49 does not cause the ink in the pressure chamber to be ejected from the nozzle 4. Hence, by expanding the inner volume of the pressure chamber 36 by the stabilizing pulse Ps, a tail end part of the ink droplet beginning to be ejected by the main pulse Pm is pulled back to the side of the nozzle 4, thereby reducing the volume of the ink droplet flying onto the recording medium. The stabilizing pulse Ps is applied at a phase to substantially offset the pressure wave in the ink in the pressure chamber 36, to damp the pulsation remaining in the ink.

Then, two experiments were conducted to optimize the pulse widths of the pulses and intervals therebetween of the drive signal. The experiments will be described by referring to FIGS. 9 and 10.

Initially, a first experiment will be described by referring to FIG. 9. First, 16 inkjet heads 100 were prepared as specimens having respective combinations (Nos. 1-16 in a table of FIG. 9) of values of the preceding, main, and stabilizing pulses Tp, Tm, Ts and intervals Wp, Wm, where an interval between the preceding pulse Pp and the main pulse Pm is represented by Wp, and an interval between the main pulse Pm and the stabilizing pulse Ps is represented by Wm. Each of the values of Tp, Wp, Tm, Wm, Ts set forth in the field of "PULSE WIDTHS AND INTERVALS" in the table of FIG. 9 is a value to be multiplied by the one-way propagation time AL, and the one-way propagation time AL is determined for each of the specimens. In the first experiment, the one-way propagation time AL of each of the inkjet heads 100 was about 5 μsec.

The first experiment of which a result is presented in the table of FIG. 9 was conducted to obtain an ink-droplet ejecting apparatus that can eject a small droplet of ink at a sufficiently high speed, and thus properties "STABILITY", "SPEED", and "VOLUME" were evaluated for each of the specimens That is, for the property "STABILITY", there was checked whether any faulty, e.g., splash, twist, or void, was seen in an image recorded by the specimen on a recording medium. For the property "SPEED", there was checked whether the ejection speed was higher than a reference speed that can ensure a sufficiently high accuracy in the landing position of the ink droplet. For the property "VOLUME", there was checked whether the volume of the ejected ink droplet was smaller than a reference volume, namely, whether the ejected ink droplet was as small as to serve as a small droplet. In the table of FIG. 9, "G" (Good) indicates that the obtained result or measurement satisfied the above-described condition for each property, and "NG" (No Good) indicates that the obtained result or measurement did not.

As can be seen from FIG. 9, only five combinations (Nos. 1-5) proved satisfactory ("G") with respect to all the three evaluated properties.

No. 1
Tp=0.33 AL
Wp=0.11 AL
Tm=0.56 AL
Wm=0.56 AL
Ts=0.33 AL

No. 2
Tp 0.22 AL
Wp=0.11 AL
Tm=0.56 AL
Wm=0.67 AL
Ts=0.44 AL

No. 3
Tp 0.22 AL
Wp=0.11 AL
Tm=0.56 AL
Wm=0.78 AL
Ts=0.33 AL

No. 4
Tp 0.20 AL
Wp=0.30 AL
Tm=0.60 AL
Wm=0.60 AL
Ts=0.20 AL

No 5
Tp=0.22 AL
Wp=0.44 AL
Tm=0.78 AL
Wm=0.67 AL
Ts=0.11 AL

From the result of the first experiment, it is found that a waveform that is most suitable for forming a small droplet satisfies all the following conditions:

0.20 AL≦Tp≦0.33 AL;
0.11 AL≦Tm≦0.44 AL;
0.56 AL≦Ts≦0.78 AL;
0.56 AL≦Wp≦0.78 AL; and
0.11 AL≦Wm≦0.44 AL.

A result obtained for a combination No. 16, where the pulse widths Tm and Ts and the intervals Wp and Wm respectively fall within the ranges set forth above, but the pulse width Tp of the preceding pulse Pp is 0.44 AL and out of the range set forth above, was not satisfactory. Further, results obtained for other combinations where Tp is 0.11 AL and at least one other time periods Tm, Ts, Wp, Wm falls out of the range set forth above were not satisfactory. However, in the experiment, it was found that a range of the pulse width Tp of the preceding pulse Pp that enables to obtain the same satisfactory result as that obtained by the five combinations can be widened compared to the optimum range of Tp set forth above, when the other time periods Tm, Ts, Wp, Wm are properly adjusted. That is, in order to obtain good results for all the three evaluated items "STABILITY", "SPEED", and "VOLUME", it suffices that Tp satisfies the following condition, given that the values of the other time periods Tm, Ts, Wp, and Wm are so adjusted: 0.1 AL≦Tp<0.44 AL. In other words, if Tp is out of this range, the satisfactory result can not be obtained in whichever way the other time periods Tm, Ts, Wp, and Wm are changed or adjusted. Similarly, it was found in the experiment that given that the other time periods are properly adjusted, a range within which each of the pulse widths Tm, Ts and the intervals Wp, Wm should be in order to obtain good results for all of the three evaluated items can be widened as compared to the optimum range thereof set forth above. That is, given that the other time periods are properly adjusted, it suffices that Wp satisfies the following condition: 0.1 AL≦Wp≦0.5 AL. In the same way, the following are the widest allowable ranges of Tm, Wm, and Ts: 0.5 AL≦Tm≦0.8 AL, 0.4 AL≦Wm≦0.8 AL, and 0.1 AL≦Ts≦0.5 AL.

By determining the waveform of the drive signal to satisfy the above-described conditions, even when the volume of the ink droplet is made small, the lowering in the ejection speed is restricted. Thus, there can be provided an inkjet head where ejection of an ink droplet is controllable without lowering the accuracy in the landing position of the ink droplet and accordingly the recording accuracy, even when the volume of the ink droplet is small.

By having the pulse widths Tp, Tm, Ts and intervals Wp, Wm fall within the above ranges with respect to the one-way propagation time AL that is a time taken by the pressure wave to propagate one way along the ink passage in the longitudinal direction thereof, the effect of the invention to reduce the size or volume of the ink droplet while preventing lowering in the ejection speed and the accuracy in the landing position can be ensured.

By having each of Ts and Wm is smaller than a half of the cycle time of the pressure wave change, or smaller than the one-way propagation time AL, the effects of reducing the heat generation and fatigue of the active portion 49, shortening the entire length of the drive signal formed of a plurality of pulses, and enhancing the frequency of driving of the active portions 49 and the recording rate, are easily achieved.

Further, by having each of Tp, Tm, Ts, Wp, and Wm smaller than a half of the cycle time of the pressure wave change, or smaller than the one-way propagation time AL, the above effects can be easily achieved.

There will be described a second experiment for optimizing the pulse widths and the intervals, by referring to FIG. 10.

First, similarly to the first experiment, 43 inkjet heads 100 were prepared as specimens having respective combinations (Nos. 1-43 in a table of FIG. 10) of values of the preceding, main, and stabilizing pulses Tp, Tm, Ts and intervals Wp, Wm. The second experiment of which a result is presented in the table of FIG. 10 was conducted to obtain an ink-droplet ejecting apparatus where the drive cycle time of ejecting small droplets is shortened, and thus properties "STABILITY" and "DENSITY" were evaluated.

For the property "STABILITY", there was checked or observed whether splash and ink mist occurred when the ink droplet was ejected. In the field "STABILIITY" in the table of FIG. 10, E (Excellent), G (Good), and NG (No Good) respectively indicate that the state of the ejection was the most stable without occurrence of the splash and ink mist observed, that the degree of the stability was inferior as compared to the most stable case but sufficient for actual use, and that the degree of the stability was insufficient for actual use. For the property "DENSIITY", the density of the dots formed on the recording medium in a dot matrix across a predetermined area was observed, to evaluate the volume of the ink droplets. That is, if the ink droplets are stably ejected in a proper volume sequentially, an image formed on the recording medium would have a predetermined density. In the field "DENSITY" in the table of FIG. 10, E (Excellent), G (Good), and NG (No Good) respectively indicate that the density was within an appropriate range, that the density was out of the range to one of the thinner and thicker side but proper enough for actual use, and that the density was excessively high or low, that is, the volume of the ink droplets was too small or too large.

In the second experiment, optimum waveforms for forming or ejecting the small droplet were of combinations (1)-(6) as put down to the right of a table of FIG. 10. The values in the table of FIG. 10 are actual values of the pulse widths and intervals in units of μsecs. In an inkjet head used in the second experiment, the one-way propagation time AL that is the time a pressure wave occurring in the ink passage including the pressure chamber 36 upon the inner volume of the pressure chamber 36 is increased, to propagate one way in the longitudinal direction of the ink passage is 4 μsecs. There will be set forth actual values (μsec) of the pulse widths and intervals, and those as expressed in units of ALs.

(1) Tp=1.5 μsec Tp=0.375 AL
Wp=0.5 μsec Wp=0.125 AL
Tm 2.5 μsec Tm=0.625 AL
Wm=2.5 μsec Wm=0.625 AL
Ts 1.5 μsec Ts=0.375 AL (2) Tp=1.5 μsec Tp=0.375 AL
Wp=0.5 μsec Wp=0.125 AL
Tm=2.5 μsec Tm=0.625 AL
Wm=2.7 μsec Wm=0.675 AL
Ts=1.5 μsec Ts=0.375 AL (3) Tp=1.5 μsec Tp=0.375 AL
Wp=0.5 μsec Wp=0.125 AL
Tm=2.5 μsec Tm=0.625 AL
Wm=2.5 μsec Wm=0.625 AL
Ts=0.7 μsec Ts=0.175 AL (4) Tp=1.5 μsec Tp=0.375 AL
Wp=0.5 μsec Wp=0.125 AL
Tm=2.5 μsec Tm=0.625 AL
Wm=2.5 μsec Wm=0.625 AL
Ts=1.1 μsec Ts=0.275 AL (5) Tp=1.5 μsec Tp=0.375 AL
Wp=0.5 μsec Wp=0.125 AL
Tm=2.5 μsec Tm=0.625 AL
Wm=2.5 μsec Wm=0.625 AL
Ts 1.3 μsec Ts=0.325 AL (6) Tp 1.7 μsec Tp 0.425 AL
Wp=0.5 μsec Wp=0.125 AL
Tm=2.5 μsec Tm=0.625 AL
Wm=2.5 μsec Wm=0.625 AL
Ts=1.5 μsec Ts=0.375 AL In all of the combinations (1)-(6), the pulse widths Tp, Tm, Ts and the intervals Wp, Wm are within the following ranges.

1.5 μsec≦Tp≦1.7 μsec 0.375 AL≦Tp≦0.425 AL
Wp=0.5 μsec Wp=0.125 AL
Tm=2.5 μsec Tm=0.625 AL
2.5 μsec≦Wm≦2.7 μsec 0.625 AL<Wm≦0.675 AL
0.7 μsec≦Ts≦1.5 μsec 0.175 AL≦Ts≦0.375 AL These ranges or values of the pulse widths and intervals as expressed in units of ALs fall within the ranges or conditions that were determined in view of the result of the first experiment described above. This verifies that the ranges or conditions determined in view of the first experiment are correct.

The pulse width Tm of the main pulse Pm is sufficiently large to change the voltage applied to the active portion 49 from the first value V1 down to the second value V2, as the main pulse Pm shown in FIGS. 7A and 7B. In the combinations where the values of the stabilizing pulse Ps and the preceding pulse Pp are relatively small, the voltage changed only to a value above V2, that is, the voltage applied to the active portion 49 for activating the active portion 49 is relatively small, as described above with respect to FIGS. 7A and 7B. In the combinations where the values of Tp and Ts are near 2 μsec, the voltage decreased down to a level near the second value V2 but within a range allowing actual use.

In the second experiment, a combination where Tp=1.9 μsec (0.475 AL) and the condition 0.1 AL≦Tp<044 AL determined in view of the first experiment is not satisfied gave an excellent result. This can be due to a combination of a relatively small value of Wp with respect to the range of Wp in the first experiment, i.e., 0.3 μsec<Wp<0.9 μsec (corresponding to 0.125 AL<Wp<0.225 AL), and the relatively large value of Tp.

Thus, the ranges of the pulse widths and intervals suitable for actual use and determined from the result of the second experiment shown in FIG. 10 while taking account of a margin and other factors are as follows:

1 μsec<Tp<2 μsec 0.25 AL<Tp<0.50 AL
0.3 μsec≦Wp<1 μsec 0.08 AL≦Wp<0.25 AL
2 μsec<Tm<3.2 μsec 0.50 AL<Tm<0.80 AL
2 μsec<Wm<3.2 μsec 0.50 AL<Wm<0.80 AL
0.7 μsec≦Ts<2 μsec 0.18 AL<Ts<0.50 AL A volume of an ink droplet ejected by a drive pulse including only the preceding pulse Pp and the main pulse Pm was two picoliters (pl). However, when the stabilizing pulse Ps was added after the main pulse Pm, the volume of the ink droplet decreased to 1.5 pl, that is, the size of the ink droplet was reduced. Further, as can be seen from the result of the second experiment described above, the pressure wave remaining in the ink after the ejection of the small droplet was damped, thereby enabling it to continuously eject a plurality of the small droplets over the predetermined area with stability.

By having the pulse widths Tp, Tm, Ts and intervals Wp, Wm fall within the above ranges with respect to the one-way propagation time AL, the effect of enhancing the recording rate can be ensured.

What is claimed is:

1. An ink-droplet ejecting apparatus comprising:

a plurality of ink passages each of which comprises a pressure chamber filled with ink;

a plurality of actuators each of which is configured to change, upon receiving a drive signal, an inner volume of one of the pressure chambers to generate a pressure wave in the ink in the pressure chamber which wave propagates along a corresponding one of the ink passages to eject a droplet of the ink onto a recording medium; and a control unit which is connected to the plurality of actuators and is configured to supply the drive signal to the actuators, such that the drive signal comprises a waveform which is for forming a single dot on the recording medium and comprises (i) a main pulse which ejects the droplet, (ii) a preceding pulse outputted before the main pulse, and (iii) a stabilizing pulse outputted after the main pulse, a pulse width of the main pulse being not coincident with a one-way propagation time AL which is a time taken by the pressure wave to propagate one way along the ink passage, the preceding pulse being outputted in a manner not to eject the droplet, and the stabilizing pulse being outputted in a manner to pull back a part of the droplet as beginning to be ejected by the main pulse, wherein each of the preceding pulse, the main pulse, and the stabilizing pulse increases the inner volume of the pressure chamber at a start of each pulse and decreases the inner volume at a terminal end of each pulse.

2. The apparatus according to claim 1, wherein the pulse width of the main pulse is smaller than the one-way propagation time AL.

3. The apparatus according to claim 1, wherein the preceding pulse vibrates the ink in the pressure chamber by increasing the inner volume of the pressure chamber and then decreasing the inner volume, wherein the main pulse ejects the ink in the pressure chamber by increasing the inner volume of the pressure chamber and then decreasing the inner volume, wherein the stabilizing pulse pulls back a part of the droplet that is beginning to be ejected, and dampens the vibration remaining in the pressure chamber, by increasing the inner volume of the pressure chamber and then decreasing the inner volume, and wherein the waveform further comprises (a) a first interval between the terminal end of the preceding pulse and the start of the main pulse and (b) a second interval between the terminal end of the main pulse and the start of the stabilizing pulse.

4. The apparatus according to claim 3, wherein the actuator is operated such that the voltage of the actuator is at a first value when the actuator is not operated, and becomes at a second value when the actuator is operated, and wherein the pulse width of the main pulse is as large as to change the voltage of the actuator from the first value to the second value, and a pulse width of the stabilizing pulse is as small as to not have the voltage of the actuator reach the second value.

5. The apparatus according to claim 4, wherein each of the pulse width of the stabilizing pulse, and the second interval is smaller than the one-way propagation time AL.

6. The apparatus according to claim 4, wherein each of a pulse width of the preceding pulse, the pulse width of the main pulse, and the first interval is smaller than the one-way propagation time AL.

7. The apparatus according to claim 3, wherein each of pulse widths of the preceding pulse, the main pulse, and the stabilizing pulse, the first interval, and the second interval is smaller than the one-way propagation time AL.

8. The apparatus according to claim 3, wherein where a pulse width of the preceding pulse, the pulse width of the main pulse, a pulse width of the stabilizing pulse, the first interval, and the second interval are respectively represented by Tp, Tm, Ts, Wp, and Wm, these time periods satisfy the following conditions with respect to the one-way propagation time: $0.1\ AL \leqq Tp < 0.44\ AL$, $0.1\ AL \leqq Wp \leqq 0.5\ AL$, $0.5\ AL \leqq Tm \leqq 0.8\ AL$, $0.4\ AL \leqq Wm \leqq 0.8\ AL$, and $0.1\ AL \leqq Ts \leqq 0.5\ AL$.

9. The apparatus according to claim 3, wherein where a pulse width of the preceding pulse, the pulse width of the main pulse, a pulse width of the stabilizing pulse, the first interval, and the second interval are respectively represented by Tp, Tm, Ts, Wp, and Wm, these time periods satisfy the following conditions satisfy the following conditions with respect to the one-way propagation time: $0.20\ AL \leqq Tp \leqq 0.33\ AL$, $0.11\ AL \leqq Wp \leqq 0.44\ AL$, $0.56\ AL \leqq Tm \leqq 0.78\ AL$, $0.56\ AL \leqq Wm \leqq 0.78\ AL$, and $0.11\ AL \leqq Ts \leqq 0.44\ AL$.

10. The apparatus according to claim 3, wherein where a pulse width of the preceding pulse, the pulse width of the main pulse, a pulse width of the stabilizing pulse, the first interval, and the second interval are respectively represented by Tp, Tm, Ts, Wp, and Wm, these time periods satisfy the following conditions with respect to the one-way propagation time: $0.25\ AL < Tp < 0.50\ AL$, $0.08\ AL \leqq Wp < 0.25\ AL$, $0.50\ AL < Tm < 0.80\ AL$, $0.50\ AL < Wm < 0.80\ AL$, and $0.18\ AL < Ts < 0.50\ AL$.

11. The apparatus according to claim 3, wherein where a pulse width of the preceding pulse, the pulse width of the main pulse, a pulse width of the stabilizing pulse, the first interval, and the second interval are respectively represented by Tp, Tm, Ts, Wp, and Wm, these time periods satisfy the following conditions with respect to the one-way propagation time: $0.375\ AL \leqq Tp \leqq 0.425\ AL$, $Wp = 0.125\ AL$, $Tm = 0.625\ AL$, $0.625\ AL \leqq Wm \leqq 0.675\ AL$, and $0.175\ AL \leqq Ts \leqq 0.375\ AL$.

12. The apparatus according to claim 3, wherein the inner volume of the pressure chamber is increased by switching a value of the voltage applied to the actuator from a first value to a second value, and the inner volume is decreased by switching the value of the voltage from the second value to the first value.

13. The apparatus according to claim 12, wherein the start of the preceding pulse is at a time when the value of the voltage is switched from the first value to the second value, and the terminal end of the preceding pulse is at a time when the value of the voltage is switched from the second value to the first value.

14. The apparatus according to claim 12, wherein the start of the main pulse is at a time when the value of the voltage is switched from the first value to the second value, and the terminal end of the main pulse is at a time when the value of the voltage is switched from the second value to the first value.

15. The apparatus according to claim 12, wherein the start of the stabilizing pulse is at a time when the value of the voltage is switched from the first value to the second value, and the terminal end of the stabilizing pulse is at a time when the value of the voltage is switched from the second value to the first value.

16. The apparatus according to claim 12, wherein the voltage applied to the actuator during the first interval is at the first value.

17. The apparatus according to claim 12, wherein the voltage applied to the actuator during the second interval is at the first value.

18. The apparatus according to claim 12, wherein the voltage applied to the actuator during a time between the start of the preceding pulse and the terminal end of the preceding pulse is at the second value.

19. The apparatus according to claim 12, wherein the voltage applied to the actuator during a time between the start of the main pulse and the terminal end of the main pulse is at the second value.

20. The apparatus according to claim 12, wherein the voltage applied to the actuator during a time between the start of the stabilizing pulse and the terminal end of the stabilizing pulse is at a second value.

21. The apparatus according to claim 1, wherein the actuator is a piezoelectric element which is displaced with respect to the pressure chamber by application of a voltage tothe actuator.

* * * * *